US008800540B1

(12) United States Patent
Choma

(10) Patent No.: US 8,800,540 B1
(45) Date of Patent: Aug. 12, 2014

(54) CROSSBOW

(75) Inventor: David Choma, Tallmadge, OH (US)

(73) Assignee: Camx Outdoors Inc., Kent, OH (US)

( * ) Notice: Subject to any disclaimer, the term of this patent is extended or adjusted under 35 U.S.C. 154(b) by 0 days.

(21) Appl. No.: 13/300,815

(22) Filed: Nov. 21, 2011

(51) Int. Cl.
*F41B 5/12* (2006.01)

(52) U.S. Cl.
USPC ..... 124/25

(58) Field of Classification Search
USPC ..... 124/25
See application file for complete search history.

(56) References Cited

U.S. PATENT DOCUMENTS

| | | | | |
|---|---|---|---|---|
| 4,649,892 | A * | 3/1987 | Bozek | 124/25 |
| 4,827,894 | A * | 5/1989 | Schallberger | 124/25 |
| 5,553,596 | A | 9/1996 | Bednar | |
| 5,598,829 | A | 2/1997 | Bednar | |
| 5,649,520 | A | 7/1997 | Bednar | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,281,534 | B2 | 10/2007 | Bednar | |
| 7,455,059 | B2 | 11/2008 | Shaffer | |
| 7,624,724 | B2 | 12/2009 | Bednar et al. | |
| 7,661,418 | B2 | 2/2010 | Bednar et al. | |
| 7,677,233 | B2 | 3/2010 | Bednar | |
| 7,779,824 | B2 | 8/2010 | Bednar | |
| 7,832,386 | B2 | 11/2010 | Bednar et al. | |
| 8,141,547 | B2 * | 3/2012 | Bednar et al. | 124/25 |
| 8,220,445 | B2 * | 7/2012 | Bednar et al. | 124/25 |
| 2009/0078243 | A1 | 3/2009 | Bednar et al. | |
| 2010/0012108 | A1 | 1/2010 | Bednar et al. | |
| 2010/0031945 | A1 | 2/2010 | Shaffer et al. | |
| 2010/0154768 | A1 | 6/2010 | Bednar et al. | |
| 2010/0186728 | A1 | 7/2010 | Bednar et al. | |
| 2011/0203561 | A1 | 8/2011 | Shaffer et al. | |
| 2011/0232619 | A1 | 9/2011 | Bednar et al. | |

OTHER PUBLICATIONS

Ten Point Crossbow Technologies, The Carbon Revolution Begins, 2011 Complete Product Guide, pp. 1-4.

* cited by examiner

*Primary Examiner* — John Ricci
(74) *Attorney, Agent, or Firm* — John D Gugliotta

(57) ABSTRACT

An improved crossbow is provided having an active finger guard that is integrated into the barrel or stock on each side of the stock which runs parallel to the track or area that the arrow sits in for a length of at least where the string is at rest to where the string is held or secured in the ready or firing position. The guard extends outward from the stock in a direction for a length that is perpendicular to the stock or axis/plane of the track or barrel covering the fingers from easily moving up into the path of the string. The guard includes a shield on each side that pivots down or out of the way as not to interfere in any way with the cocking or drawing phase of the crossbow be it done by hand or with the assistance of what is known and understood to be a cocking aid. Each shield is spring urged upward so as to always be deployed in a protective position.

20 Claims, 6 Drawing Sheets

CROSSBOW

BACKGROUND OF THE INVENTION

1. Field of the Invention

The present invention relates generally to crossbows and, more particularly, to an improved crossbow having and active finger guard mechanism.

2. Description of the Related Art

One of the common problems and safety issues with crossbow operation is that by design and nature the string of the crossbow moves back and forth in a horizontal plane unlike a conventional bow which moves its string along a vertical plane. The principles in which a crossbow is held are almost identical to that of a rifle or similar shoulder firearm. In fact, it would be easy to possibly confuse the appearance of the crossbow stock with that of a rifle. As such, the crossbow is held in almost the same identical manner.

In actual operation, a typical crossbow requires the use of both hands. The strong or dominate hand is usually placed in the area of the stock that is called the grip and is responsible for not only holding the stock but its primary role is to control the firing control mechanism. The weak or support hand is responsible for supporting, steadying and aiming or aligning the sighting system. This is well know and currently the common principles of most all forms of marksmanship. These principles of marksmanship facilitate that the support hand be in front of the strong hand and fire control system or trigger. Excepted principles of marksmanship also suggest that the closer the support hand can be to the center of the bore or plane that the projectile travels down the better and more accurate/stable the weapon can be aimed. When the hand is placed further from the center of the axis then the ability to roll or rotate during sighting is greater.

The well established danger with gripping the stock in its frontal position also known as the forend is that on a crossbow the hand and fingers are located under or below the path in which the string travels and back and forth during firing. When the crossbow is cocked or loaded the string of the crossbow is storing forward energy and when fired or released said string moves forward under tremendous force and speed back to its resting or uncocked position. It is very easy for most all crossbow users to inadvertently get his fingers or thumb from the support hand in the way of the string path which can cause great bodily harm and injury. Due to similarities in stock design and marksmanship principles and previous use and or experiences with rifles the crossbow user is at great risk. With rifles this danger does not exist because the support hand is well behind the muzzle or end that the projectile may exit where any potential risk could arise.

It is common, and a well known fact that parts of the support hand, digits and or thumb are frequently placed and left in the path of the string waiting to be impacted and or damaged when the string is allowed to be released forward during the natural and normal firing cycle. Crossbow manufactures continue to apply warnings directly to their products and to operation and safety manuals warning of the great potential danger.

Manufactures have tried to haphazardly address the problem by designing stocks or elements within their stocks that attempt to force or locate the support hand well below the string path. While this may offer a solution or aid in reducing the threat it is not desired by the end user or does it insure that the end user actually place his support hand in the designed area. The forend areas of the stocks have become very massive and heavy and are not comfortable to the end user and reduce the ability to correctly steady and aim the crossbow.

Depressions, valleys, grooves and cavities have been incorporated into the stocks as well as raised rails, ribs and or flanges all in an attempt to hold the fingers and thumb out or below the path of the string.

Today's modern crossbows typically have draw weights in excess of 150 pounds and may be as high as 200 or more pounds of force and can easily be cocked by hand. Drawing the crossbow by hand is quick and does not require the use of time consuming aids and or complicated expensive accessories. One in the art would assume that a solution to keeping the fingers out of the string path would be to place a large flange outward from the stock for some length to block or guard the fingers from entering the string path. The problem with this type of approach is that it widens the track portion of the stock which the arrow sits in and is in the center of the string's path forward. If this area was to be widened over or above the proposed gripping area, which again there is no way to assure that the end user would actually grip the crossbow stock in the intended area, it would interrupt the smooth surface that is used as a guide to ensure the crossbow is cocked on center or symmetrical. As the string is drawn rearward the angle and or pinch placed on the hands and fingers becomes greater the further back. The addition of such a flange which would be wide enough and long enough to allow ample protection of the fingers throughout the string path would cause an excessive, almost unbearable pinch and pressure on the hands/fingers to the point that cocking the crossbow by hand would be impossible.

A search of the prior art did not disclose any patents that read directly on the claims of the instant invention. Of considerable relevance is U.S. Pat. No. 7,661,418, issued in the name of Bednar et al. While grip guard member that extends outwardly in a direction that is substantially perpendicular to the is incorporated into this invention in combination, other elements are different enough as to make the combination distinguished over the inventors' own prior art.

Consequently, a need has been felt for providing an apparatus for and method of operating a crossbow in a safe manner.

SUMMARY OF THE INVENTION

It is therefore an object of the present invention to provide an improved crossbow.

It is a feature of the present invention to provide an improved crossbow having and active finger guard mechanism.

Briefly described according to one embodiment of the present invention, an improved crossbow is provided having a guard that is integrated into the barrel or stock on each side of the stock which runs parallel to the track or area that the arrow sits in for a length of at least where the string is at rest to where the string is held or secured in the ready or firing position. Said guard extends outward from the stock in a direction for a length that is perpendicular to the stock or axis/plane of the track or barrel covering the fingers from easily moving up into the path of the string. The invention would ideally extend forward or ahead of the string at rest to so that it could easily be pushed down out of the way prior to cocking or drawing the string rearward. The invention allows the guard or shield on each side to pivot down or out of the way as not to interfere in any way with the cocking or drawing phase of the crossbow be it done by hand or with the assistance of what is known and understood to be a cocking aid.

In accordance with a preferred embodiment, a finger guard is always in a constant up position and held there by a mechanical means which can be pushed down out of the way so as not to interfere with the normal cocking function of the crossbow. It is an improvement to such a configuration that immediately upon completion of the cocking phase and when the hands or cocking aid are removed the guard automatically is raised or redeployed to its protective position without any user aid or assistance.

Further, the guard may be positioned or the shield may be designed or of a shape that stops on or minimally rests against the lower portion of the string to ensure its upper most position runs the entire length of the power stroke so as not to snag or grab the string.

Further still, the guard or shields are mechanically attached in a manner that keeps them secure to the crossbow stock assembly and that removal of said safety device requires user interaction and removal.

Finally, the shields as defined by the present invention may be made from any of known and excepted materials and manufacturing processes, may be decorated or colored to call attention or warning, and may also contain text or labels to give further warning and or instruction.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
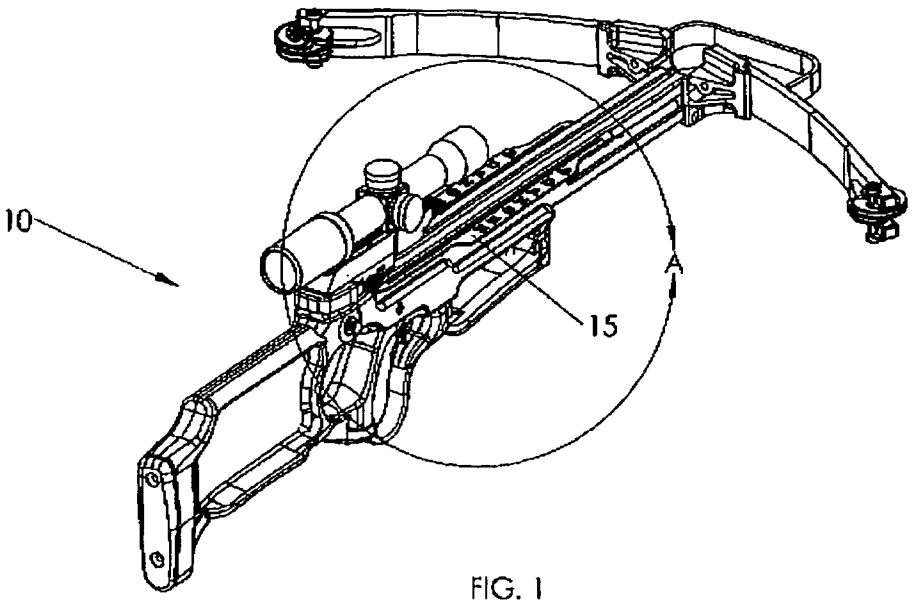
FIG. 1 is a perspective view of an improved crossbow according to the preferred embodiment of the present invention having an active finger guard mechanism 15 shown in a deployed condition.

The best mode for carrying out the invention is presented in terms of its preferred embodiment, herein depicted within the Figures.

1. Detailed Description of the Figures

Referring to FIG. 1 through FIG. 8, an improved crossbow, generally noted as 10, is provided having a guard system 15 that is integrated into the barrel or stock 20 on each side of the stock which runs parallel to the track 25 or area that the arrow sits in for a length of at least where the string (not shown) is at rest to where the string is held or secured in the ready or firing position. The guard system 15 incorporates a pair of shields 30, each pivotally affixed along the stock, and extend outward from the stock 30 in a direction for a length that is perpendicular to the stock 30 or axis/plane of the track 25 or barrel covering the fingers from easily moving up into the path of the string. In a preferred embodiment each shield 30 would extend forward or ahead of the string at rest to so that it could easily be pushed down out of the way prior to cocking or drawing the string rearward.

Each shield 30 is affixed such as to pivot down or out of the way as not to interfere in any way with the cocking or drawing phase of the crossbow, be it done by hand or with the assistance of what is known and understood to be a cocking aid.

Figure 2:
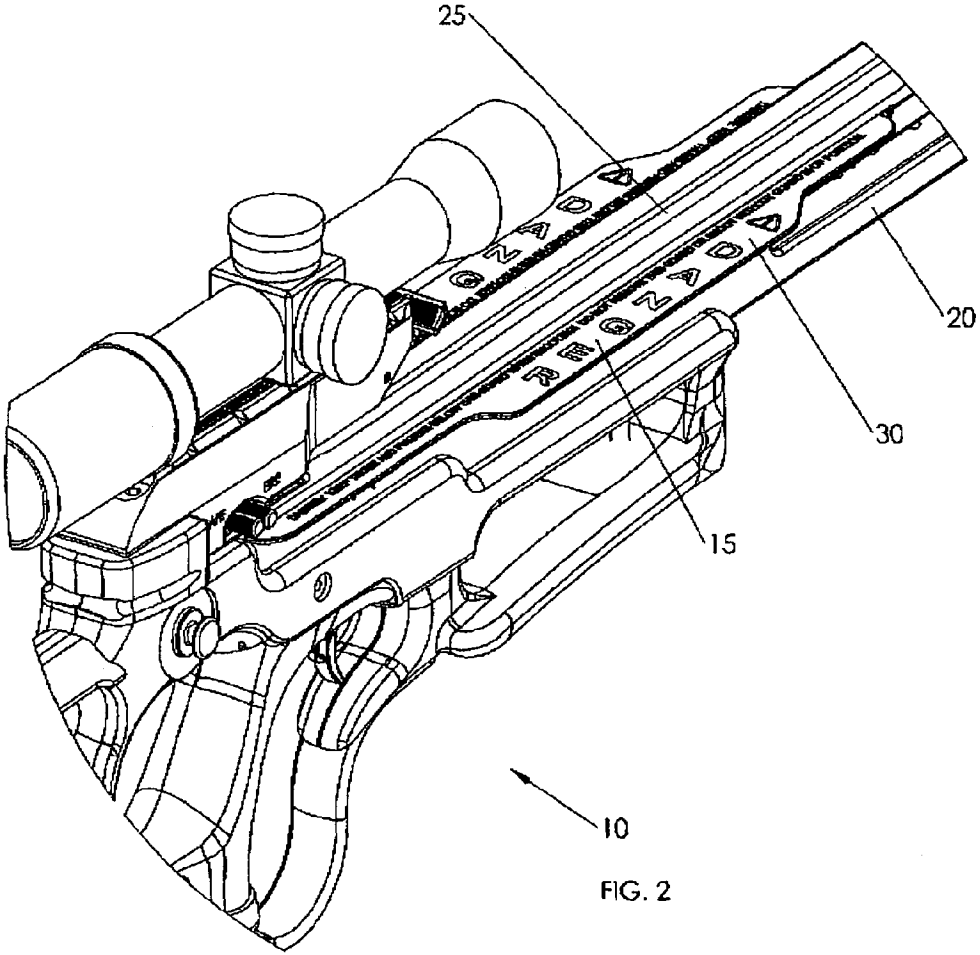
FIG. 2 is an partial, enlarged detail view thereof taken along detail A of FIG. 1.
Figure 3:
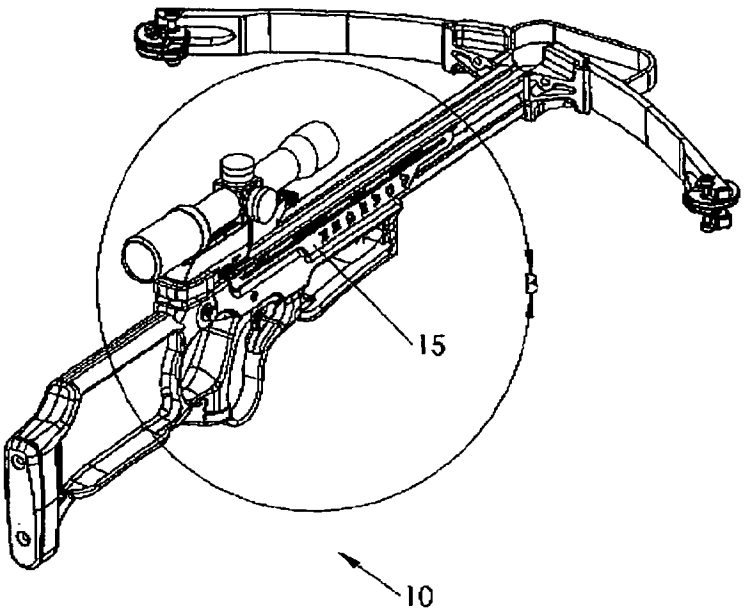
FIG. 3 is a perspective view of an improved crossbow according to the preferred embodiment of the present invention having an active finger guard mechanism 15 shown in a retracted condition.
Figure 4:
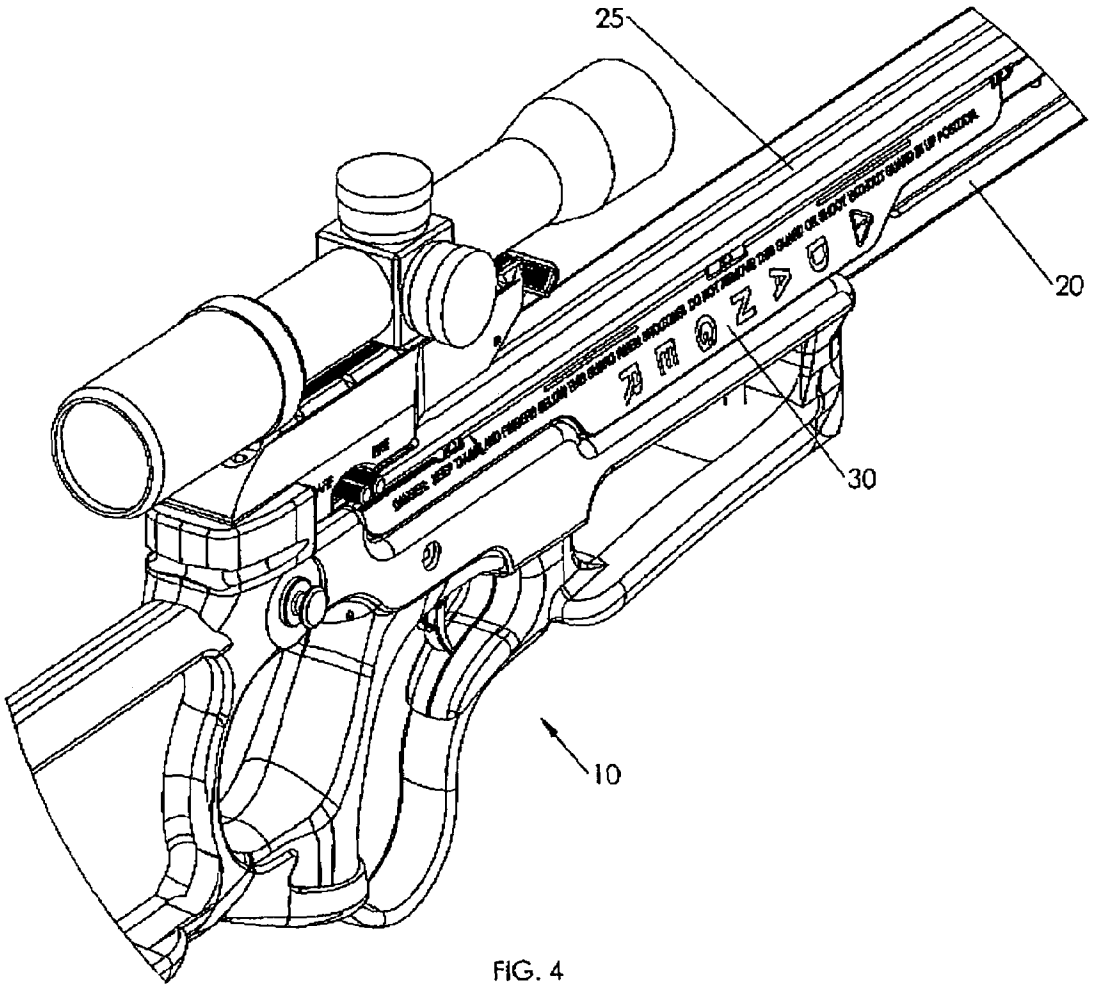
FIG. 4 is an partial, enlarged detail view thereof taken along detail B of FIG. 3.
Figure 6:
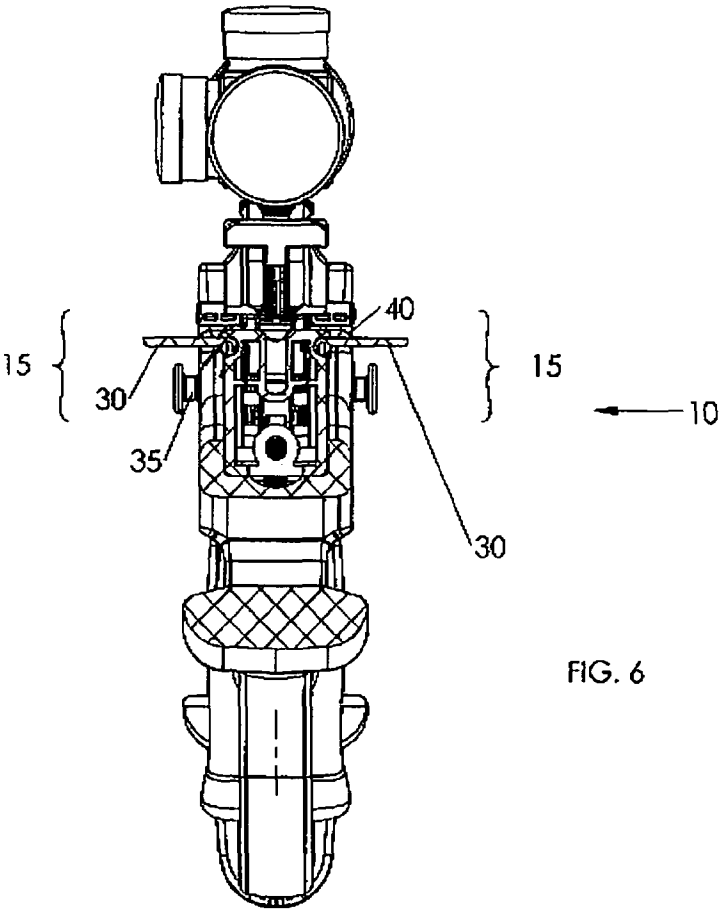
FIG. 6 is an partial, enlarged detail view thereof taken along section VI-VI of FIG. 8.
Figure 5:
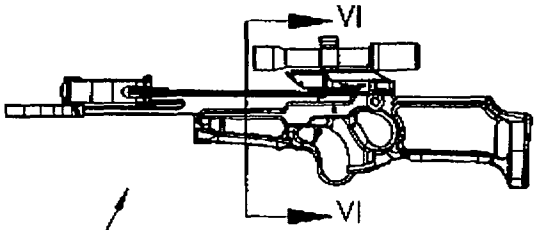
FIG. 5 is a side elevational view of an improved crossbow according to the preferred embodiment of the present invention having an active finger guard mechanism 15 shown in a deployed condition.
Figure 8:
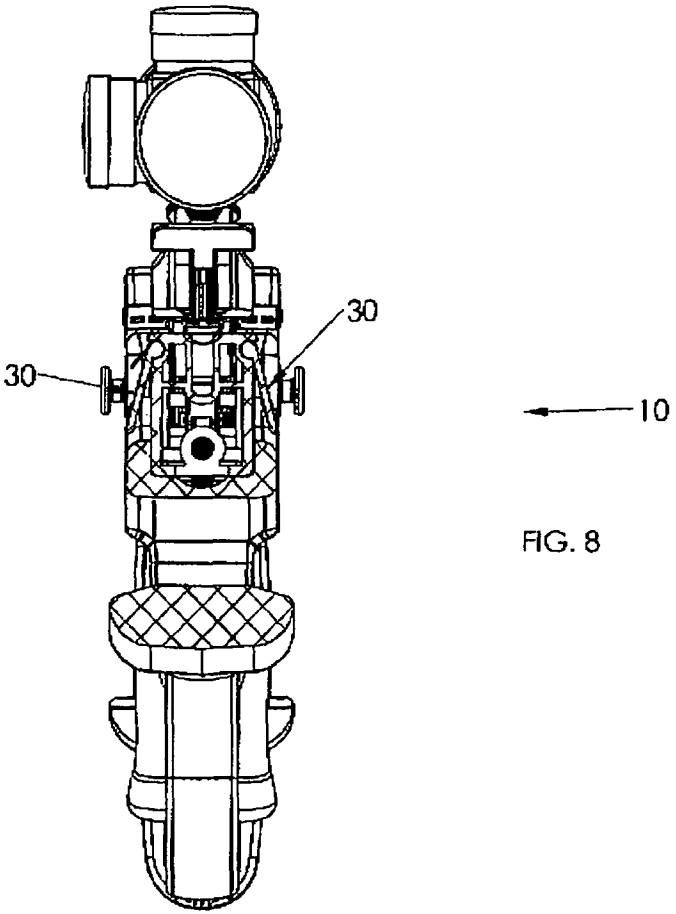
FIG. 8 is an partial, enlarged detail view thereof taken along detail VIII-VIII of FIG. 7.
Figure 7:
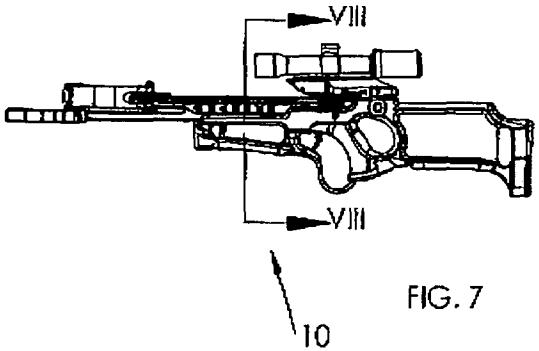
FIG. 7 is a side elevational view of an improved crossbow according to the preferred embodiment of the present invention having an active finger guard mechanism 15 shown in a retracted condition.

As shown best in conjunction with FIG. 2 and FIG. 6, the shield 30 is always in a constant up position and held there by a mechanical means, such as, for example, a spring 35, which can urge the shield 30 upward, but which can still be overcome to pushed the shield 30 down out of the way so as not to interfere with the normal cocking function of the crossbow (as shown best in conjunction with FIGS. 4 and 8). Immediately upon completion of the cocking phase and when the hands or cocking aid are removed, the guard shield 35 will automatically be raised or urged into a deployed protective position without any user aid or assistance. Other mechanical means, such as a motor, may also be equivalently used to urge the shield 30 upward. In any equivalent, the spring or motor may be positioned in such a manner it is hidden or covered from the elements or conditions associated with typical hunting environments.

As depicted best in conjunction with FIG. 2 and FIG. 4, the guard mechanism 15 may utilize a shield 30 of any shape and of a width that offers reasonable depth to cover or protect the fingers from entering the string path. It is preferred that such a shield 30 length be at a minimum of the known power stroke of the crossbow or from the position where the string lies at rest to where it is when it's cocked waiting to be fired. Ideally the length is longer to facilitate the fact that when you grab the sting with your fingers or a cocking aid they push the shields down out of the way to a position that has minimally increased the barrel or stock width.

2. Operation of the Preferred Embodiment

In operation, the features and benefits of the present invention may be incorporated into the manufactured structure of a crossbow grip and barrel, or may alternately be adapted to add the operational features and benefits through attachment to elements of a separate crossbow. However, in any embodiment, the guard may be positioned below but relatively close to the string to allow the hand to be positioned under and closer to the guard while offering protection to the thumb/finger yet allowing for a higher grip or position of the support hand. In any embodiment, the guard is urged or positioned to be returnable to a constant up position and held there by a mechanical means, but yet which can be pushed down out of the way so as not to interfere with the normal cocking function of the crossbow.

While it should be understood that the guard or shield can be located on either side of the center of the stock to protect either left or right handed shooters to insure that the fingers are protected, it is also anticipated that the guard or shield can be located on both sides of the center of the stock to protect both left and right handed shooters to insure the protection of the thumb as well as the fingers. Typical use of the crossbow would have the support hand holding the stock with the users thumb located on one side of the stock while the fingers would be gripping the other side. In such an embodiment the guard or shields may work independent of each other.

While the guard system 15 is integrated into the barrel or stock 20, it is further anticipated that the shields 30 incorporated into the stock may be formed of wood, plastic, aluminum or other common material in a manner such as to be incorporated into the barrel or track of the crossbow or to allow a difference between the two components.

Additionally, a travel stop 40 may be incorporated into either the shield/guard or, as shown herein, the stock/barrel may, and may be either in a fixed or adjustable in such a manner as to limit the travel or position of the shield 30 when it is up or deployed to keep it from contacting the string and/or interfering with the strings forward and rearward motions. This is especially important if the shield 30 where to be designed shorter than the power stroke of the crossbow where it could then rise above the string and be damaged during firing or interfere with the cocking processes. It is anticipated that such a travel stop feature maybe incorporated into the components or act as a separate piece or hard stop.

Further still, the guard may be positioned, or the shield may be designed or of a shape that stops on or minimally rests against the lower portion of the string to ensure its upper most position runs the entire length of the power stroke so as not to snag or grab the string.

The guard or shields are located on either side of the center of the string to protect both left and right handed shooters as well as insure that the thumb is also protected as well as the fingers. Typical use of the crossbow would have the support hand holding the stock with the users thumb located on one side of the stock while the fingers would be gripping the other side. As such, the guard or shields should be capable of rotatably operating independent of each other.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A crossbow comprising:

a crossbow grip guard having a pivoting member that extends for a length in a direction that is substantially parallel to the longitudinal axis of a crossbow barrel or stock, and that attaches to and extends outwardly in a direction that is substantially perpendicular to a stock when deployed and extends downwardly in a direction that is substantially parallel to the stock when retracted.

2. An improved crossbow comprising:

a guard that is integrated into the barrel or stock on at least one side of the stock, said guard running parallel to the track or area that the arrow sits in for a length of at least where the string is at rest to where the string is held or secured in the ready or firing position;

said guard being pivotally affixed such as to rotate between a deployed position and a retracted position; and a mechanical deployment mechanism for urging said guard to said deployed position; wherein in said deployed position said guard extends outward from the stock in a direction for a length that is perpendicular to the stock or axis/plane of the track or barrel covering the fingers from easily moving up into the path of the string.

3. The improved crossbow of claim 2, comprising said guard that is integrated into the barrel or stock on each side of the stock.

4. The improved crossbow of claim 3, wherein said guard on each side of the stock pivot down or out of the way as not to interfere in any way with the cocking or drawing phase of the crossbow.

5. The improved crossbow of claim 3, wherein said guards work independently of each other and are located on either side of the center of the stock to protect both left and right handed shooters as well as ensure that the thumb is also protected as well as the fingers.

6. The improved crossbow of claim 2, wherein said guard extends forward or ahead of the string at rest so that it can be pushed down out of the way prior to cocking or drawing the string rearward.

7. The improved crossbow of claim 2, wherein said mechanical deployment mechanism comprises a spring for urging said guard to a constant up position but which can be overcome to push said guard down out of the way so as not to interfere with the normal cocking function of the crossbow.

8. The improved crossbow of claim 2, wherein said guard is adapted to a length that is of the known power stroke of the crossbow.

9. The improved crossbow of claim 2, wherein said guard is adapted to a length such that when a user grabs the string with the user's fingers or a cocking aid, the guards are impinged to pushed down out of the way to a position that has minimally increased the barrel or stock width.

10. The improved crossbow of claim 2, wherein said mechanical deployment mechanism is positioned in such a manner such that it is hidden or covered from the elements or conditions associated with typical hunting environments.

11. The improved crossbow of claim 2, wherein said mechanical deployment mechanism further comprises a travel stop to limit the position of said guard when deployed such as to keep it from contacting the string and/or interfering with the strings forward and rearward motions.

12. In a crossbow having a barrel or stock forming a track area that an arrow sits in and having a thrust string crossing the track area generally perpendicularly and traveling above and along an axis parallel to the barrel or stock, the improvement comprising:

a guard system to protect a user's thumb as well as the fingers for both left and right handed shooters in combination with said crossbow and forming a pivoting shield for pivoting down or out of the way as not to interfere in any way with the cocking or drawing phase of the crossbow and returning to a shielding position during operation of the crossbow.

13. The improvement of claim 12, wherein said shield is affixed to at least one side of the barrel and running parallel to the track or area that the arrow sits in for a length of at least where the string is at rest to where the string is held or secured in the ready or firing position.

14. The improvement of claim 13, wherein said shield is pivotally affixed such as to rotate between a deployed position and a retracted position, and further comprises:

a mechanical deployment mechanism for urging said guard to said deployed position;

wherein in said deployed position said guard extends outward from the stock in a direction for a length that is perpendicular to the stock or axis/plane of the track or barrel covering the fingers from easily moving up into the path of the string.

15. The improvement of claim 14, comprising said guard system is integrated into the barrel or stock on each side of the stock.

16. The improvement of claim 14, wherein said mechanical deployment mechanism comprises a spring for urging said guard to a constant up position but which can be overcome to push said guard down out of the way so as not to interfere with the normal cocking function of the crossbow.

17. The improvement of claim 16, wherein said guard is adapted to a length that is of the known power stroke of the crossbow and further such that when a user grabs the string with the user's fingers or a cocking aid, the guards are impinged to pushed down out of the way to a position that has minimally increased the barrel or stock width.

18. The improved of claim 12, wherein said guard system is located on each side of the stock and each side pivots down or out of the way independently as not to interfere in any way with the cocking or drawing phase of the crossbow.

19. The improvement of claim 12, wherein said mechanical deployment mechanism is positioned in such a manner such that it is hidden or covered from the elements or conditions associated with typical hunting environments.

20. The improvement claim 19, wherein said mechanical deployment mechanism further comprise a travel stop to limit the position of said guard when deployed such as to keep it from contacting the string and/or interfering with the strings forward and rearward motions.

* * * * *